US008869338B1

(12) United States Patent
Dooley et al.

(10) Patent No.: US 8,869,338 B1
(45) Date of Patent: Oct. 28, 2014

(54) APPARATUS FOR HOLDING A CLEANING SHEET IN A CLEANING IMPLEMENT

(71) Applicant: Evolution Robotics, Inc., Pasadena, CA (US)

(72) Inventors: Michael Dooley, Pasadena, CA (US); Nikolai Romanov, Oak Park, CA (US)

(73) Assignee: iRobot Corporation, Beford, MA (US)

( * ) Notice: Subject to any disclaimer, the term of this patent is extended or adjusted under 35 U.S.C. 154(b) by 0 days.

(21) Appl. No.: 13/685,476

(22) Filed: Nov. 26, 2012

Related U.S. Application Data

(62) Division of application No. 12/985,257, filed on Jan. 5, 2011, now Pat. No. 8,316,499.

(60) Provisional application No. 61/292,760, filed on Jan. 6, 2010.

(51) Int. Cl.
*A47L 13/256* (2006.01)
*A47L 11/40* (2006.01)

(52) U.S. Cl.
CPC ..... *A47L 11/40* (2013.01)
USPC ..... 15/98; 15/147.1; 15/231; 15/319

(58) Field of Classification Search
USPC ..... 15/98, 147.1, 150, 228, 231, 232; 451/354, 514, 515, 507, 518, 523, 524, 451/525
See application file for complete search history.

(56) References Cited

U.S. PATENT DOCUMENTS 3,224,149 A * 12/1965 Harrington et al. ..... 451/518
4,516,361 A * 5/1985 Gringer ..... 451/524

(Continued)

FOREIGN PATENT DOCUMENTS

WO WO 01/91623 A2 12/2001
WO WO 01/91624 A2 12/2001

OTHER PUBLICATIONS

European Patent Office; Notification of Transmittal of the International Search Report and the Written opinion of the International Searching Authority, or the Declaration, the International Search Report, and the Written Opinion of the International Searching Authority; PCT/US2009/041728, Sep. 10, 2009; Rijswijk, The Netherlands.

(Continued)

*Primary Examiner* — Monica Carter
*Assistant Examiner* — Michael Jennings
(74) *Attorney, Agent, or Firm* — Knobbe, Martens, Olson & Bear LLP

(57) ABSTRACT

Cleaning devices which use cleaning sheets affixed in traps are disclosed. The traps comprise first and second jaws, each comprising base and forward portions, each forward position having a forward surface. The forward portion of the second jaw is flexible in at least a first direction, such as towards a surface over which the device is configured to move. When the second jaw is relaxed, the forward portion of the second jaw is substantially coplanar with the forward portion of the first jaw and the forward surfaces are proximate or touching. When the second jaw is flexed in the first direction (e.g., by the application of a force from a user), the forward surface of the forward portion of the second jaw moves in the first direction, away from the forward surface of the first jaw. This opens a gap through which a portion of a sheet may be inserted.

20 Claims, 9 Drawing Sheets

(56) References Cited

U.S. PATENT DOCUMENTS

| | | | | |
|---|---|---|---|---|
| 5,440,216 | A | 8/1995 | Kim | |
| 5,512,010 | A * | 4/1996 | Labad, Jr. | 451/344 |
| 5,621,291 | A | 4/1997 | Lee | |
| 5,701,630 | A | 12/1997 | Liao | |
| 5,720,077 | A | 2/1998 | Nakamura et al. | |
| 5,815,880 | A | 10/1998 | Nakanishi | |
| 5,841,259 | A | 11/1998 | Kim et al. | |
| 5,894,621 | A | 4/1999 | Kubo | |
| 5,902,176 | A * | 5/1999 | Chen | 451/524 |
| 5,940,927 | A | 8/1999 | Haegermarck et al. | |
| 5,959,423 | A | 9/1999 | Nakanishi et al. | |
| 5,991,951 | A | 11/1999 | Kubo et al. | |
| 5,998,953 | A | 12/1999 | Nakamura et al. | |
| 6,012,618 | A | 1/2000 | Matsuo | |
| 6,076,025 | A | 6/2000 | Ueno et al. | |
| 6,119,057 | A | 9/2000 | Kawagoe | |
| 6,142,252 | A | 11/2000 | Kinto et al. | |
| 6,202,250 | B1 * | 3/2001 | Kenmochi et al. | 15/231 |
| 6,296,558 | B1 * | 10/2001 | Poole et al. | 451/557 |
| 6,305,046 | B1 * | 10/2001 | Kingry et al. | 15/231 |
| 6,338,013 | B1 | 1/2002 | Ruffner | |
| 6,459,955 | B1 | 10/2002 | Bartsch et al. | |
| 6,481,515 | B1 | 11/2002 | Kirkpatrick et al. | |
| 6,540,424 | B1 | 4/2003 | Hall et al. | |
| 6,580,246 | B2 | 6/2003 | Jacobs | |
| 6,641,469 | B2 * | 11/2003 | Deshler | 451/514 |
| 6,685,547 | B2 * | 2/2004 | Boman | 451/495 |
| 6,741,054 | B2 | 5/2004 | Koselka et al. | |
| 6,771,217 | B1 | 8/2004 | Liu et al. | |
| 6,779,217 | B2 | 8/2004 | Fisher | |
| 6,901,624 | B2 | 6/2005 | Mori et al. | |
| 6,938,298 | B2 | 9/2005 | Aasen | |
| 7,013,528 | B2 * | 3/2006 | Parker et al. | 15/403 |
| 7,015,831 | B2 | 3/2006 | Karlsson et al. | |
| 7,113,847 | B2 | 9/2006 | Chmura et al. | |
| 7,135,992 | B2 | 11/2006 | Karlsson et al. | |
| 7,145,478 | B2 | 12/2006 | Goncalves et al. | |
| 7,162,338 | B2 | 1/2007 | Goncalves et al. | |
| 7,177,737 | B2 | 2/2007 | Karlsson et al. | |
| RE39,581 | E | 4/2007 | Stuchlik et al. | |
| 7,272,467 | B2 | 9/2007 | Goncalves et al. | |
| 7,320,149 | B1 | 1/2008 | Huffman et al. | |
| 7,337,494 | B2 * | 3/2008 | Baer et al. | 15/403 |
| 7,346,428 | B1 | 3/2008 | Huffman et al. | |
| 7,416,477 | B2 * | 8/2008 | Henke et al. | 451/344 |
| 7,451,516 | B2 * | 11/2008 | Tanaka | 15/228 |
| 7,480,958 | B2 | 1/2009 | Song et al. | |
| 7,488,242 | B2 * | 2/2009 | Gringer et al. | 451/344 |
| 7,506,397 | B2 * | 3/2009 | Tanaka | 15/228 |
| 7,568,255 | B1 * | 8/2009 | Krebs | 15/104.93 |
| 7,607,192 | B2 * | 10/2009 | Flora et al. | 15/231 |
| 7,670,210 | B2 * | 3/2010 | Annis | 451/523 |
| 7,784,139 | B2 | 8/2010 | Sawalski et al. | |
| 7,832,048 | B2 | 11/2010 | Harwig et al. | |
| 7,895,700 | B2 * | 3/2011 | Tanaka | 15/231 |
| 8,469,775 | B2 * | 6/2013 | Dow et al. | 451/59 |
| 2002/0002751 | A1 | 1/2002 | Fisher | |
| 2002/0011813 | A1 | 1/2002 | Koselka et al. | |
| 2002/0152569 | A1 * | 10/2002 | Zorzo | 15/147.1 |
| 2002/0175648 | A1 | 11/2002 | Erko et al. | |
| 2003/0229421 | A1 | 12/2003 | Chmura et al. | |
| 2004/0031113 | A1 | 2/2004 | Wosewick et al. | |
| 2004/0045126 | A1 * | 3/2004 | Parker et al. | 15/403 |
| 2004/0244138 | A1 | 12/2004 | Taylor et al. | |
| 2005/0209736 | A1 | 9/2005 | Kawagoe | |
| 2005/0217061 | A1 | 10/2005 | Reindle | |
| 2005/0229340 | A1 | 10/2005 | Sawalski et al. | |
| 2005/0278888 | A1 | 12/2005 | Reindle et al. | |
| 2006/0085095 | A1 | 4/2006 | Reindle et al. | |
| 2006/0288519 | A1 | 12/2006 | Jaworski et al. | |
| 2006/0293794 | A1 | 12/2006 | Harwig et al. | |
| 2006/0293809 | A1 | 12/2006 | Harwig et al. | |
| 2007/0061040 | A1 | 3/2007 | Augenbraun et al. | |
| 2007/0214586 | A1 * | 9/2007 | Mattucci et al. | 15/4 |
| 2008/0104783 | A1 | 5/2008 | Crawford et al. | |
| 2008/0276407 | A1 | 11/2008 | Schnittman et al. | |
| 2009/0133720 | A1 | 5/2009 | Van Den Bogert | |
| 2009/0281661 | A1 | 11/2009 | Dooley et al. | |
| 2010/0009609 | A1 * | 1/2010 | Dow et al. | 451/522 |

OTHER PUBLICATIONS

The International Bureau of WIPO; Notification Concerning Transmittal of International Preliminary Report on Patentability, International Preliminary Report on Patentability, and Written Opinion of the International Searching Authority; PCT/US2009/041728, dated Nov. 4, 2010; Geneva, Switzerland.

* cited by examiner

APPARATUS FOR HOLDING A CLEANING SHEET IN A CLEANING IMPLEMENT

CROSS-REFERENCE TO RELATED APPLICATIONS

This application is a divisional application of U.S. patent application Ser. No. 12/985,257, filed Jan. 5, 2011, which claims the benefit under 35 U.S.C. §119(e) of U.S. Provisional Application No. 61/292,760, filed Jan. 6, 2010, the contents of which are incorporated herein by reference in their entirety.

BACKGROUND

1. Field

What is disclosed herein relates to holding sheets.

2. Description of the Related Art

Certain cleaning solutions involve the use of cleaning or mopping cloths or sheets. Sweeper devices exist that are configured to hold such cleaning sheets so that one or more held portions of a sheet are in a fixed position relative to the holder and an unheld portion of the sheet is in relative tension against a surface of the device. However, many conventional cleaning sheet holding mechanisms may result in injury or discomfort to the user when mounting the sheet in the holder. Many also result in non-uniform tensioning of the sheet and/or poor holding performance.

SUMMARY

Certain embodiments disclosed herein are composed of one or more traps comprising a first jaw comprising a base portion and a forward portion having a forward surface and a semi-rigid second jaw comprising a base portion spaced from the base portion of the first jaw and a forward portion having a forward surface, the forward portion of the second jaw flexible in at least a first direction substantially orthogonal to the forward portion of the second jaw. When the second jaw is relaxed (e.g., in a natural condition, with no external forces applied to it to cause it to flex), the forward portion of the second jaw is substantially coplanar with the forward portion of the first jaw and the forward surface of the forward portion of the second jaw faces the forward surface of the forward portion of the first jaw. When the second jaw is flexed in the first direction such as by the application of a force from a user or operator, the forward surface of the forward portion of the second jaw is spaced further from the forward surface of the forward portion of the first jaw than it is when the second jaw is relaxed.

Some embodiments comprise a robot comprising a body and a platform associated with the body (e.g., an integral part of the body or removably attached to it), the platform having a first surface facing away from the body and substantially parallel to and facing towards a surface in an environment in which the robot is configured to move. The embodiment may have a plurality of substantially longitudinal traps attached to a second surface of the platform (opposite to the first surface of the platform) so that at least two of the traps are positioned on substantially parallel longitudinal lines. The first trap is configured to receive a first portion of a sheet and the second trap is configured to receive a second portion of the sheet, the first portion of the sheet spaced from the second portion of the sheet such that when the first sheet portion is received by the first trap and the second sheet portion is received by the second trap, a third sheet portion between the first and second sheet portions may be held against the first surface of the platform.

The first trap may be configured as described above. For example, it may comprise a first jaw comprising a base portion and a forward portion having a forward surface and a semi-rigid second jaw comprising a base portion spaced from the base portion of the first jaw and a forward portion having a forward surface, the forward portion flexible in at least a first direction substantially orthogonal to the forward portion (i.e., when the robot is placed on a surface so as to travel over it, the first direction is substantially in the direction towards that surface). When the second jaw is relaxed, the forward portion of the second jaw is substantially coplanar with the forward portion of the first jaw and the forward surface of the forward portion of the second jaw faces the forward surface of the forward portion of the first jaw. When the second jaw is flexed in the first direction such as by the application of a force, the forward surface of the forward portion of the second jaw is spaced further from the forward surface of the forward portion of the first jaw than it is when the second jaw is relaxed. The robot may be configured to move in the environment in accordance with logic contained in an on-board processor.

BRIEF DESCRIPTION OF THE DRAWINGS

The disclosed aspects will hereinafter be described in conjunction with the appended drawings, which are provided to illustrate and not to limit the disclosed aspects. Like designations denote like elements.

DETAILED DESCRIPTION OF PREFERRED EMBODIMENTS

Generally

Described herein are methods and systems for holding a sheet. Certain embodiments may use one or more holders, and certain embodiments may use two or more holders to keep a sheet relatively taut against a surface of an object to which the sheet is otherwise unattached. Some embodiments are such that they are amenable to use by a user with minimal risk of injury to that user's fingers as compared to certain known sheet holding systems.

While this invention is susceptible of embodiments in many different forms, this specification and the accompanying drawings disclose only some specific forms as examples of the invention.

Support Structure for a Cleaning Sheet

Illustrated in FIGS. 1-8 and described herein is an example holding apparatus for holding a dusting, mopping, or cleaning sheet configured for use in dusting, mopping, or cleaning a floor (sometimes collectively referred to herein as "cleaning"). For example, the sheet may be impregnated with mineral oil and/or wax to help trap dirt and dust when swept across a work surface, such as a floor. In addition or instead, the sheet may be impregnated with cleaning solutions and/or wood preservatives, such as cleaning solutions including some or all of the following ingredients and/or other ingredients: purified water, butoxypropanol, alkyl polyglycoside, dialkyl dimethyl ammonium chloride, polyoxyethylene castor oil, linear alkylbenzene sulfonate, sodium salt, acrylic copolymer, benzisothiazolinone, cleaning agents, fragrances, etc.

The example holding apparatus comprises a support structure and traps that may be substantially linear and which optionally extend longitudinally for most of the length of the support structure. The illustrated apparatus provides a gripping surface for a sheet, such as a cleaning sheet, for substantially the length of the support structure, if the sheet is at least that long; a substantially uniform tension on the sheet across the support structure; and an intuitive and "pinch-free" sheet insertion operation that reduces or substantially eliminates the risk of a user's fingers being pinched when inserting the sheet into the holder. The more secure holding of the sheet relative to that provided by conventional holders enables the use of such cleaning sheets in applications where there is no human supervision, such as in the case of a robotic cleaning implement which needs to operate without user supervision. As such a robot moves over a surface, the sheet preferably stays in place in the holder to prevent or reduce the possibility of entanglement of the sheet with the robot wheels (or other means of movement, such as treads, or other components of the robot) or with furniture or other obstacles in the environment in which the robot moves.

Figure 1:
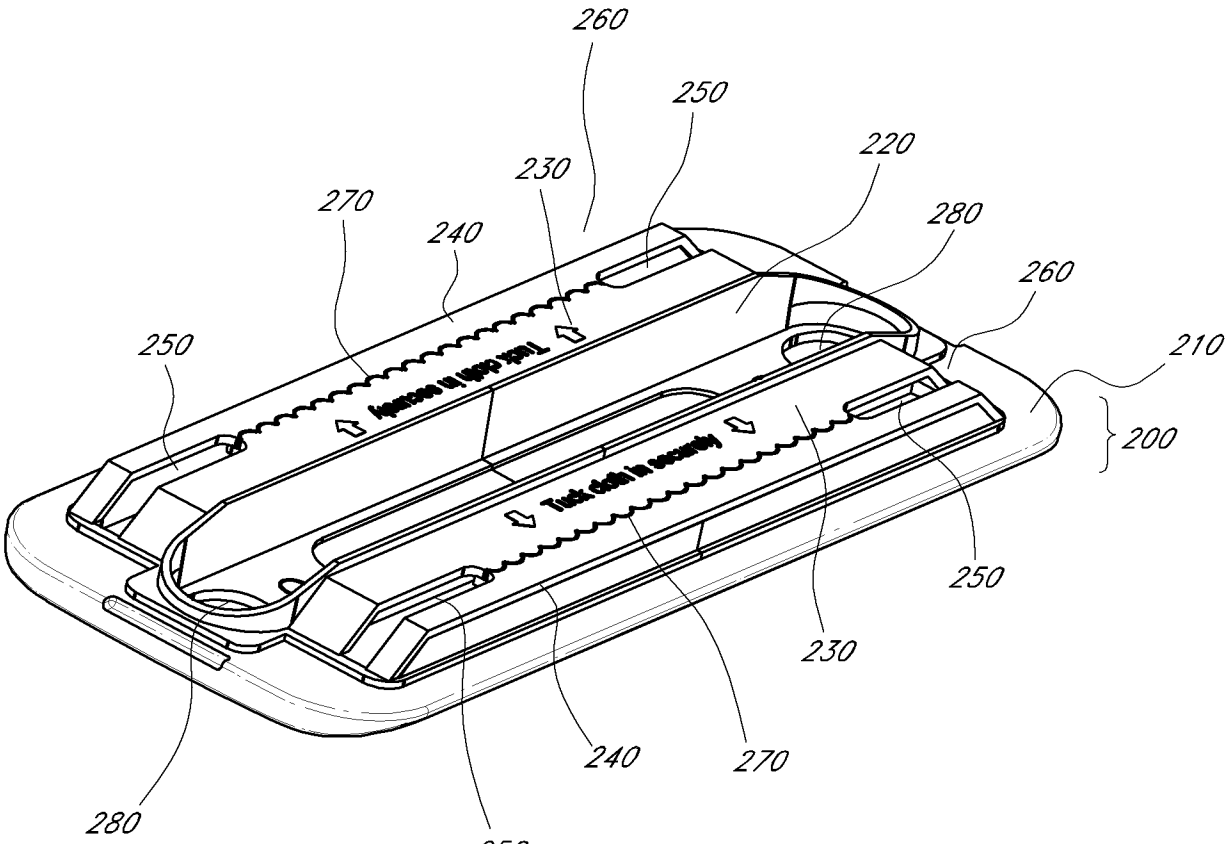
FIG. 1 illustrates an isometric view of an example embodiment comprising two holders arranged so as to hold a sheet against a pad and FIG. 1B illustrates an example embodiment of a robot.
Figure 1B:
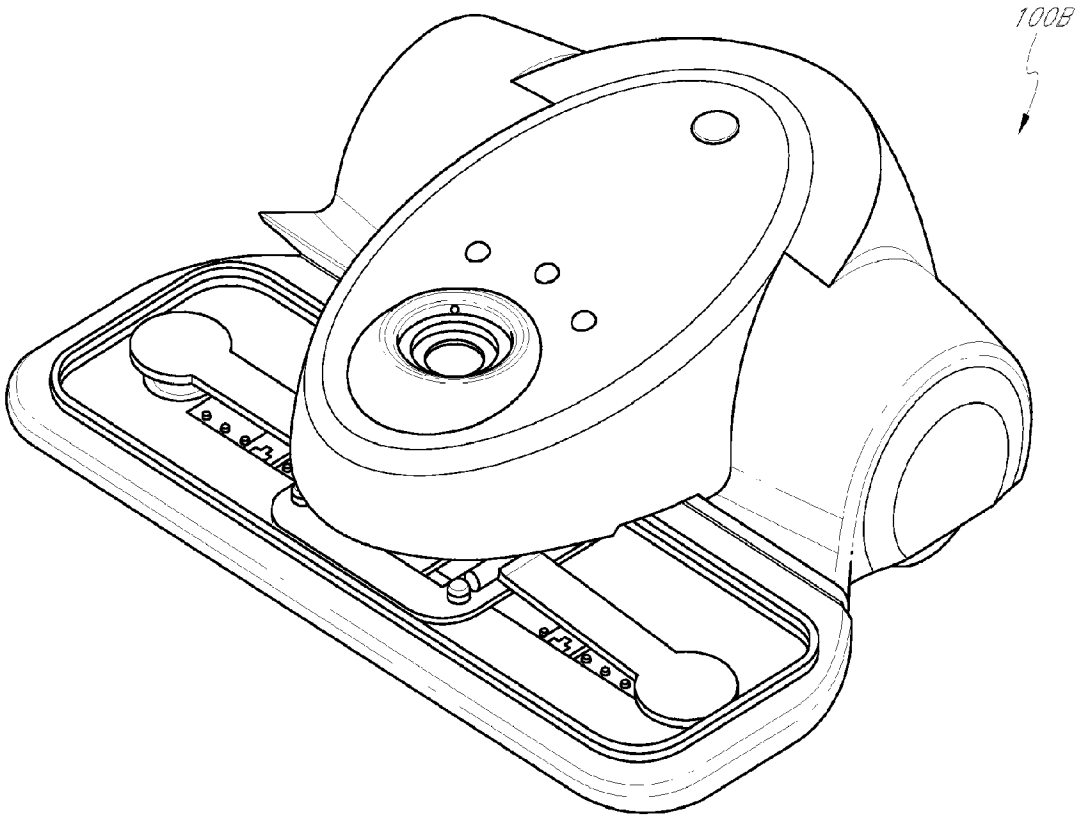

FIG. 1 illustrates an embodiment of a support structure for a cleaning sheet. In U.S. patent application Ser. No. 12/429,963 filed on Apr. 24, 2009 and hereby incorporated by reference herein, a robot apparatus and system are described for performing multiple cleaning functions on the floor, including a dusting and a mopping function. A support structure such as that illustrated in FIG. 1 may be configured to attach to a robotic floor cleaning apparatus disclosed therein. An example embodiment of a robot 100B is illustrated in FIG. 1B herein. Another embodiment is configured to attach to a pole, rod, or similar handle apparatus. Yet another embodiment is configured to attach to a hand grip.

Figure 3:
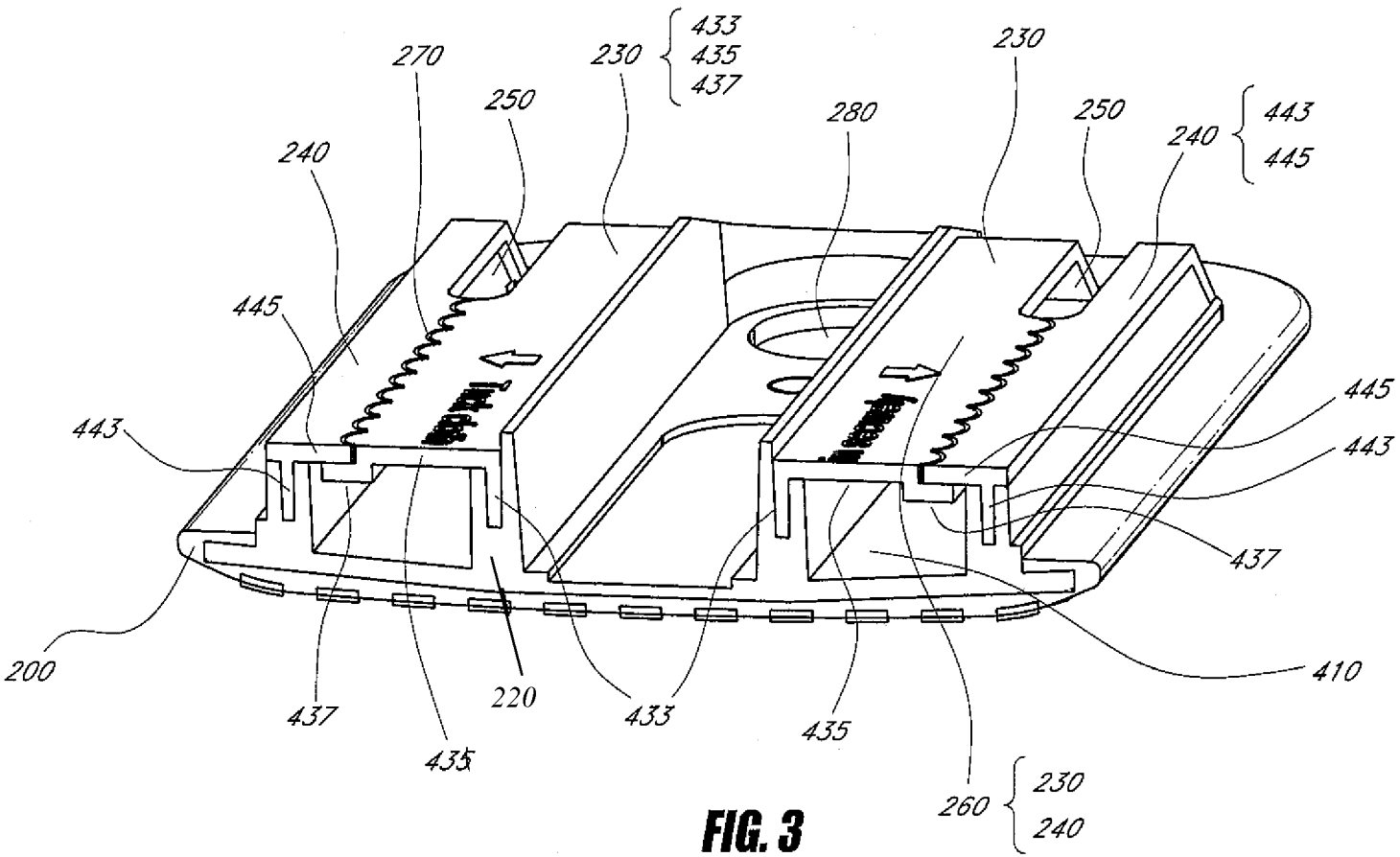
FIG. 3 illustrates an isometric view of a cross-section of an example embodiment such as that of FIG. 1.

The support structure illustrated in FIG. 1 includes a pad 200 (which may be a plate or other structure and may have a first surface 210 and a bottom surface 310), a support chassis 220, and one or more sheet traps 260 extending longitudinally on either side of the support structure. The pad 200 may be integral with the support chassis 220 or may be removably associated with it. Some or all of the illustrated traps 260 includes two grip jaws: an inner jaw 230 and an outer jaw 240. The grip jaws 230, 240 meet or come close to meeting at a slit 270 over a cavity 410 (FIG. 3). For example, the two jaws of a trap 260 may remain 1.0 mm, 0.5 mm, 0.1 mm or less apart, although other dimensions may be used. The slit 270 may also be 1.5 mm, 5.0 mm, or 1.0 cm wide or wider, although other dimensions may be used. Functionally, the slit 270 may be configured so that it is at least narrow enough such that when the trap 260 is used to hold a sheet, the sheet can not easily slip out of the trap 260. Optionally, the sheet will slip out of the trap 260 if a pulling pressure above a certain predefined level is applied to the sheet, perhaps at a particular angle.

In one embodiment, the width of the support structure (i.e., its extent from left of the first trap 260 to right of second trap 260 in FIG. 1) is approximately 101 mm, and in some embodiments it may range from approximately 90 mm to approximately 120 mm, while in other embodiments it may be larger or smaller. The length of the support structure may be approximately 248 mm, and some embodiments may be as short as approximately 200 mm (or shorter) and other embodiments may be as long as approximately 280 mm (or longer). A pad 200 may have substantially identical dimensions to the support structure as a whole, or may be slightly shorter, longer, wider, or narrower, (e.g., it may vary by 1 mm, 2 mm, or a small percentage ranging up to 5% or more in any dimension). The pad 200 may, but need not, be geometrically similar in shape to the support structure in general. E.g., the pad 200 may be substantially oval shaped while the support chassis 220 defines a substantially rectangular shape for the support structure.

As shown in FIG. 1, in an example embodiment, slit 270 is optionally overall substantially linear and is locally comprised of repeated semicircular sections. This may be obtained by the inner jaw 230 having rounded/semicircular convex teeth with more angular/sharper concave indentations and the outer jaw 240 having substantially complementary angular or pointy protrusions and rounded/semicircular concave indentations. Such a configuration may facilitate the inner jaw 230 and outer jaw 240 aligning if there is substantially no gap in the slit 270. In other embodiments, the configuration of the inner jaw 230 and the outer jaw 240 need not be complementary, resulting in at least occasional gaps in the slit 270, even if portions of the slit 270 have substantially no gap. In some embodiments, the outer jaw 240 may be configured as described above for the inner jaw 230 (i.e., with rounded protrusions) and the inner jaw 230 configured as described above for the outer jaw 240 (i.e., with more angular protrusions). In some embodiments of a trap 260, both jaws have angular protrusions. In others, both jaws have rounded protrusions. Rounded protrusions need not be semi-circular and may, for example, be semi-elliptical or have another shape that is generally more curved than angular.

As will become more apparent below, rounded teeth on the inner jaw 230 help prevent a sheet from snagging on the teeth as the sheet is removed by a user from the trap 260, such as for disposal or cleaning. An outer jaw 240 having teeth with a sharper profile (i.e., more angular or pointed protrusions) may help prevent accidental removal of the sheet, which in use may experience a pressure that presses the sheet against the more angular teeth.

The cavity 410 may be as wide or as deep as necessary or desired for a particular use. In one embodiment, the height of a cavity 410 (i.e., the distance from upper portions 435 and 445 to the bottom of cavity 410, if a bottom is present) is approximately 12.5 mm. In other embodiments it may range from approximately 10 mm to approximately 30 mm, while in still other embodiments it may be larger or smaller. In one embodiment, the width of a cavity 410 (i.e., the distance from left to right, as illustrated) is approximately 15 mm. In some embodiments, the width is between approximately 11 mm and approximately 31 mm. In still other embodiments, it may be wider or narrower. In some embodiments, the cavity may be substantially wider, such as 10 cm, 0.5 meters, 1.0 meters, or more. A sheet trap 260 may have larger or smaller dimensions (including cavity dimensions) depending, in part, on the nature (e.g., the dimensions) of the sheet or sheets being held in the trap 260. Thus, some embodiments may have a depth of approximately 0.1 cm, 0.5 cm, 1.0 cm, 5 cm, or larger (such as 10 cm, 0.5 meters, 1.0 meters, or more). In one embodiment, the depth and width of the cavity are such that a flexible portion of inner jaw 230 may be pushed at least partially into the cavity using a finger or a tool, as discussed below.

In an example embodiment, the jaws 230, 240 are attached (e.g., rigidly or flexibly hinged) on one side to the side walls of the cavity 410 (e.g., to appropriate portions of the support chassis 220), extend over the cavity 410, and meet over the cavity 410 to form a slit 270 having a desired profile.

In the illustrated embodiment, the inner jaw 230 is wider than the outer jaw 240. In other embodiments the outer jaw 240 is wider. The jaws may be of substantially equal width, or the width of the jaws may vary such that some parts of the outer jaw 240 are wider than some parts of the inner jaw 230 and vice versa.

Support chassis 220 is optional and may be removable if present. The support chassis 220 is configured as appropriate for a device and attachment mechanism used with the embodiment (e.g., it might have magnets, screw heads and/or holes, mating snap portions, and/or other removable or non removable attachment mechanisms). The support chassis 220 may also comprise a grip or handle, as mentioned above.

A cavity 410 covered by the inner jaw 230 and outer jaw 240 may be divided by one or more cross-cavity dividers such that it appears to have two or more cells. Some or all of these dividers may rise to the level of the slit 270. With some such configurations, portions of the more flexible jaw (e.g., the inner jaw 230) may have divisions corresponding to the dividers such that that the jaw can be flexed into the cavity 410 without being blocked by the dividers.

Figure 5:
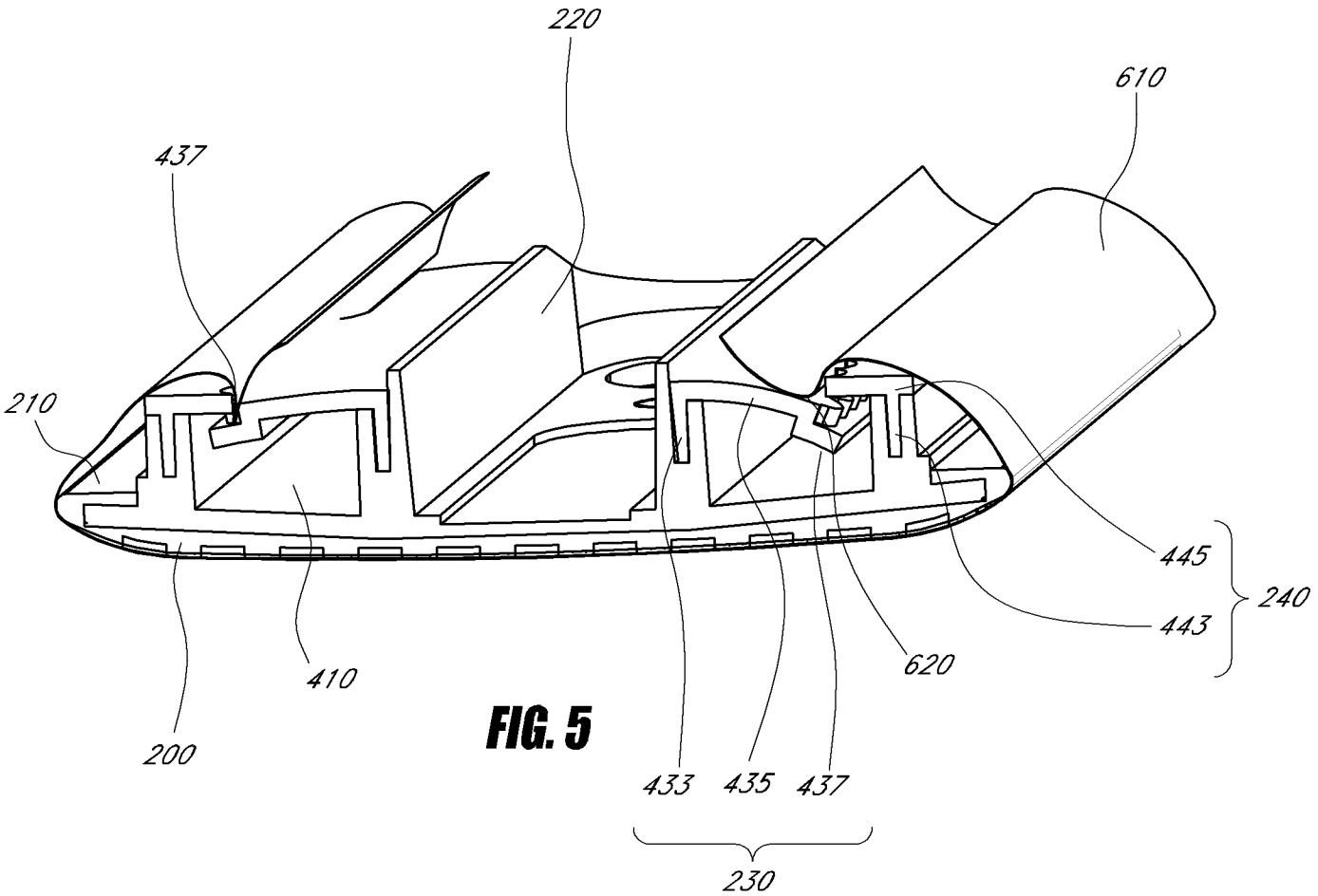
FIG. 5 illustrates an isometric view of flexed portions (as for sheet insertion or removal) of an embodiment such as that of FIG. 1.

Embodiments may have more than one trap 260. For example, one or both of the traps 260 in FIG. 1 may be replaced by two or more traps, each of which is shorter than the trap 260 they replace and which are aligned end to end so that they are collinear longitudinally and collectively extend approximately the same length as the trap 260 which they replace. Another embodiment may replace one or both traps 260 with two or more longitudinally parallel traps 260, such that an end of the sheet is "double-gripped" with a portion of the end held by the first replacement trap and a second portion of the end held by the second replacement trap, for example. FIG. 5 further illustrates how a sheet may be held in a support structure.

Traps 260 need not be substantially linear. They may, for example, be curved or angled. Other embodiments of the support structure may include sheet traps 260 arranged on a skew relative to the orientation of the support structure.

The jaws 230, 240 may be made of a semi-soft pliable material such as a flexible rubber or plastic. Inner jaw 230 and outer jaw 240 need not be made of the same material. The various traps 260 of embodiments with more than one trap 260 may be comprised of different materials as well. In one embodiment, inner jaw 230 is made from silicone rubber and outer jaw 240 from natural rubber. The pad 200 may also be pliable, or it may be of a substantially rigid material.

In an example embodiment, the apparatus shown in FIG. 1 may be removable associated with a top portion that encloses or covers the traps 260. For example, elements (e.g., two metal disc-shaped inserts), not visible in FIG. 1, are located along the longitudinal axis of the support structure and separated by about ½ of the overall length of the support structure. Two magnets may be located in a top portion. The metal elements provide a connection with the top portion when the elements come in contact with the two magnets (which may be hemispheric in shape or may be otherwise shaped) placed in corresponding locations on the top portion, such as when the support structure is placed and/or snapped into a matching cavity of the top portion. This may, for example, result in a removably sealed structure containing the traps 260 and other structures illustrated in FIG. 1.

Optionally, the support structure fits (e.g., very tightly) into the top portion resulting into a rigid configuration. In another embodiment of the invention, the support structure fits loosely into the top portion, therefore allowing the support structure to pivot around the axis connecting the center of the two hemispheric magnets.

Bottom of a Support Structure

Figure 2:
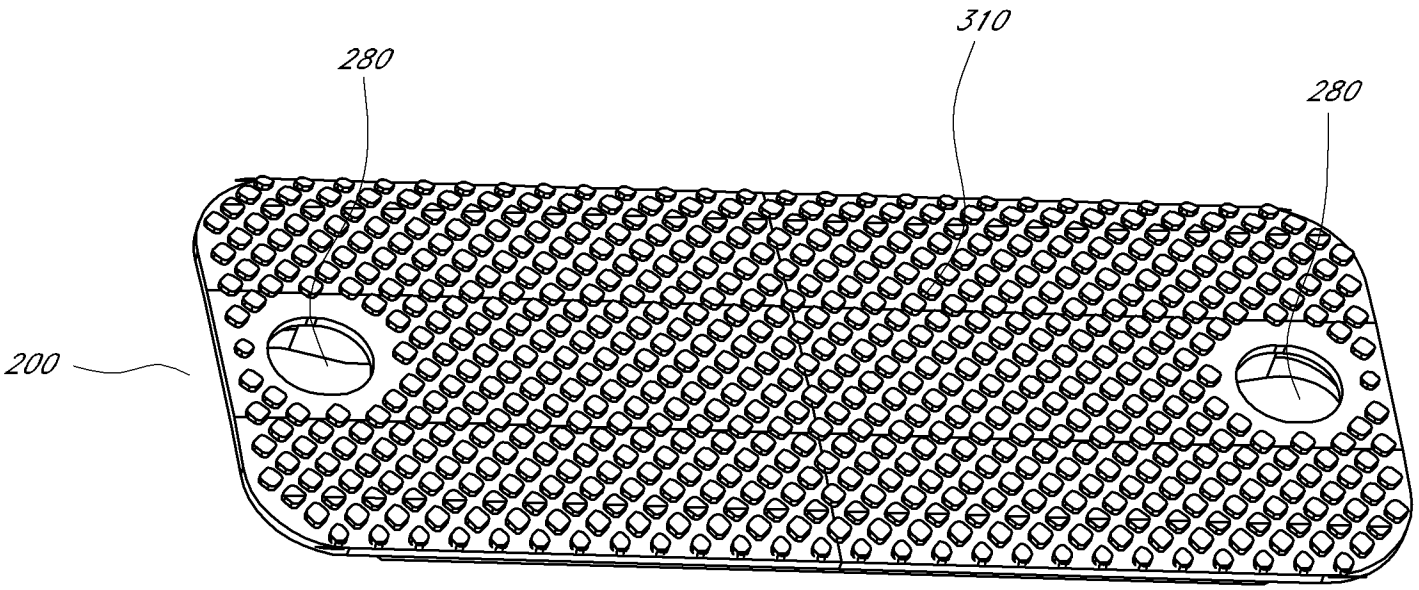
FIG. 2 illustrates an isometric view of the side of the pad against which the sheet is held in the embodiment of FIG. 1.

FIG. 2 shows an example bottom of a support structure such as that of FIG. 1. This view shows the bottom surface 310 of the pad 200. Illustrated pad 200 has an optional textured bottom surface 310, which may be a 3-dimensional pattern of bumps designed to increase the friction (e.g., resistance to lateral motion) between a sheet and the pad 200 and also provide an even or substantially even distribution of the pressure over the surface of a sheet when the apparatus is traveling over a surface that is not substantially planar (e.g., when traveling over a threshold connected to floors at slightly different heights).

In one embodiment, one or more holes 280 (e.g., two holes), visible in both FIG. 1 and FIG. 2, allow for sensors, such as drop-off sensors. Such sensors might be housed on the top portion of the cleaning assembly of a robotic cleaner, otherwise associated with a robotic cleaner, associated with another apparatus to which the support structure is attached, or housed in the support structure itself, for example. The holes 280 allow the sensors to make direct contact with the sheet and, though it, the surface over which the sheet is moving. In this way, sensors can relay information to a robot or otherwise provide feedback on properties of the surface and of the sheet proximate to the surface. Information that might be reported in this way include whether there is a drop off (e.g., a hole in the surface) below the sheet, whether the pad has been lifted off the surface, changes in the texture of the surface, the moisture level of the sheet, the absorption status of the sheet, and the like.

Traps in a Relaxed (Closed, Rest) Position

Figure 4:
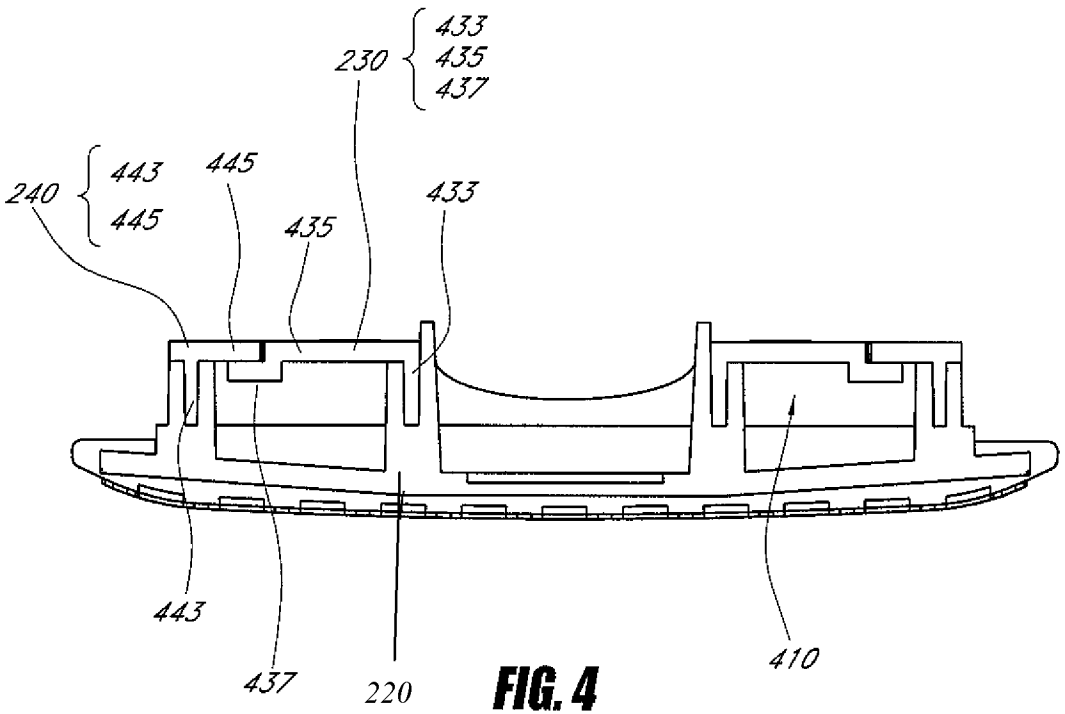
FIG. 4 illustrates an orthographic view of the cross-section of the embodiment illustrated in FIG. 3.

FIG. 3 and FIG. 4 are two sectional views of the support structure showing portions of the traps 260 with the grip jaws 230 and 240 in a rest position. This may also be referred to as a closed, relaxed, or unflexed position. The rest position is a position that a trap 260 may assume when it is not holding a sheet and any pressure applied to inner jaw 230 or outer jaw 240 is insufficient to flex one or both of the jaws 230, 240.

These figures show that a trap 260 may comprise an inner jaw 230 and an outer jaw 240. The jaws, in the illustrated position, substantially cover the top of a cavity 410. In FIG. 3, the base of cavity 410 is formed at least in part by portions of the support chassis 220. In other embodiments the base may be formed at least in part by portions of pad 200, or by a junction of portions of the inner jaw 230 and the outer jaw 240 (e.g., in some embodiments a trap 260 may be formed from an inner jaw 230 and an outer jaw 240 which are attached to each other at a common bottom portion, to which one or both may be rigidly (and optionally removably) attached and which may be an integral part of one or both). In still other embodiments, the cavity 410 may have no base (and thus may be thought of as having an infinite depth or no depth).

In the illustrated embodiment, inner jaw 230 has a base portion 433 which is substantially fixed to a substrate, such as the support chassis 220. It also has an upper portion 435, which is connected to the base portion 433. The upper portion 433 is also referred to as the forward portion. As shown, the base portion 433 of the inner jaw 230 is embedded in the support chassis 220 and is substantially orthogonal to the upper portion 230. In other embodiments, the base portion 433 may be substantially coplanar with the upper portion 435 and, for example, there may be no obvious physical distinction between where the upper portion 435 ends and the base portion 433 begins. For example, if base portion 433 did not extend downwards into the support chassis 220 as illustrated but was instead welded, glued, integrally formed, riveted, or otherwise mechanically attached to the support chassis 220 along a back edge of the upper portion 435, then that back edge and a proximate portion of the upper portion 435 could be referred to as the base portion 433. Outer jaw 240 may have analogous base portion 443 and upper portion 445.

The cumulative widths of the upper portions 435, 445 of a trap 260 may be approximately 26 mm. In other embodiments, the cumulate width may range from approximately 20 mm or less to approximately 40 mm or more. More generally, the width may be more or less than the width of cavity 410. For example, if the cumulative width of the upper portions is less than the width of the cavity 410, then it may be that slit 270 is sufficiently wide to account for the difference. If the cumulative width of the upper portions is more than the width of the cavity 410, it may be that structure such as parts of the support chassis 220 or the base portions 433 and 443 are present below the upper portions, in what would otherwise be cavity 410.

The upper portion 435 of the inner jaw 230 terminates in a forward surface or edge which may be scalloped or finished with curved or angular protrusions as discussed above. The terms forward surface and forward edge are used interchangeably: at times it is helpful to consider the forward surface of an upper portion such as 435 or 445 as being sufficiently thin so as to be an edge. As shown in the figures, the upper portions 435,445 have a noticeable thickness and thus have forward surfaces.

When a trap 260 is in the illustrated relaxed position, the forward edge or surface of the upper (forward) portion 435 of inner jaw 230 is proximate to a forward edge or surface of an upper (forward) portion 445 of outer jaw 240. The forward surfaces of the upper portions of the jaws 230, 240 face each other. The upper portions 435 and 445 may be substantially coplanar with each other. As described above, the two forward edges (surfaces) of the upper portions 435, 445 form slit 270. In some embodiments, the upper portions 435 and 445 may be angled relative to each other such that they are not substantially coplanar, but their forward surfaces still face each other to form a slit 270. The upper portion 445 of the outer jaw 240 is connected to (or transitions into) a base portion 443 of the outer jaw 240. The upper portion 443 is also referred to as the forward portion. The base portion 443 of the outer jaw 240 is relatively fixed, similarly to the base portion 433 of the inner jaw 230. A trap 260 need not have both base portion 433 and base portion 443 fixed in the same manner. For example, one may be fixed to a support chassis 220 and the other may be fixed to pad 200.

Optionally, the inner jaw 230, outer jaw 240, or both jaws of a trap 260 may have a seal portion. For example, inner jaw 230 may have a seal portion 437. One advantage conferred by a seal portion 437 is that it helps ensure that a flexible upper portion 435 of an inner jaw 230 does not flex upwards, above the upper portion 445 of outer jaw 240, for example when there is an upward pressure on the upper portion 435 due to pulling on the sheet caused by the motion of the structure along a surface. In some embodiments, seal portion 437 also helps prevent a sheet from being wedged too tightly in the trap 260.

As illustrated, a seal portion 437 may extend beyond the forward edge of upper portion 435 so as to extend under the upper portion 445. The seal portion 437 may be attached to upper portion 435. In an embodiment with seal portion 437 as illustrated, inner jaw 230 can be flexed downward as described herein, but upward flexing is substantially resisted and opposed by the action of seal portion 437 against relatively rigid upper portion 445 of the second jaw 240. Other embodiments may have a similar seal portion attached to upper portion 445 of outer jaw 240, the seal portion extending beyond and above the forward edge of upper portion 435 of inner jaw 230. A seal portion above the upper portion 435 of inner jaw 230 need not be attached to the outer jaw 240 and may, for example, be attached to an outer perimeter of the apparatus or to the previously mentioned optional top portion which encloses the illustrated structures.

FIG. 4 presents a different view of the embodiment illustrated in FIG. 3.

Traps in a Flexed (Open) Position

Figure 6:
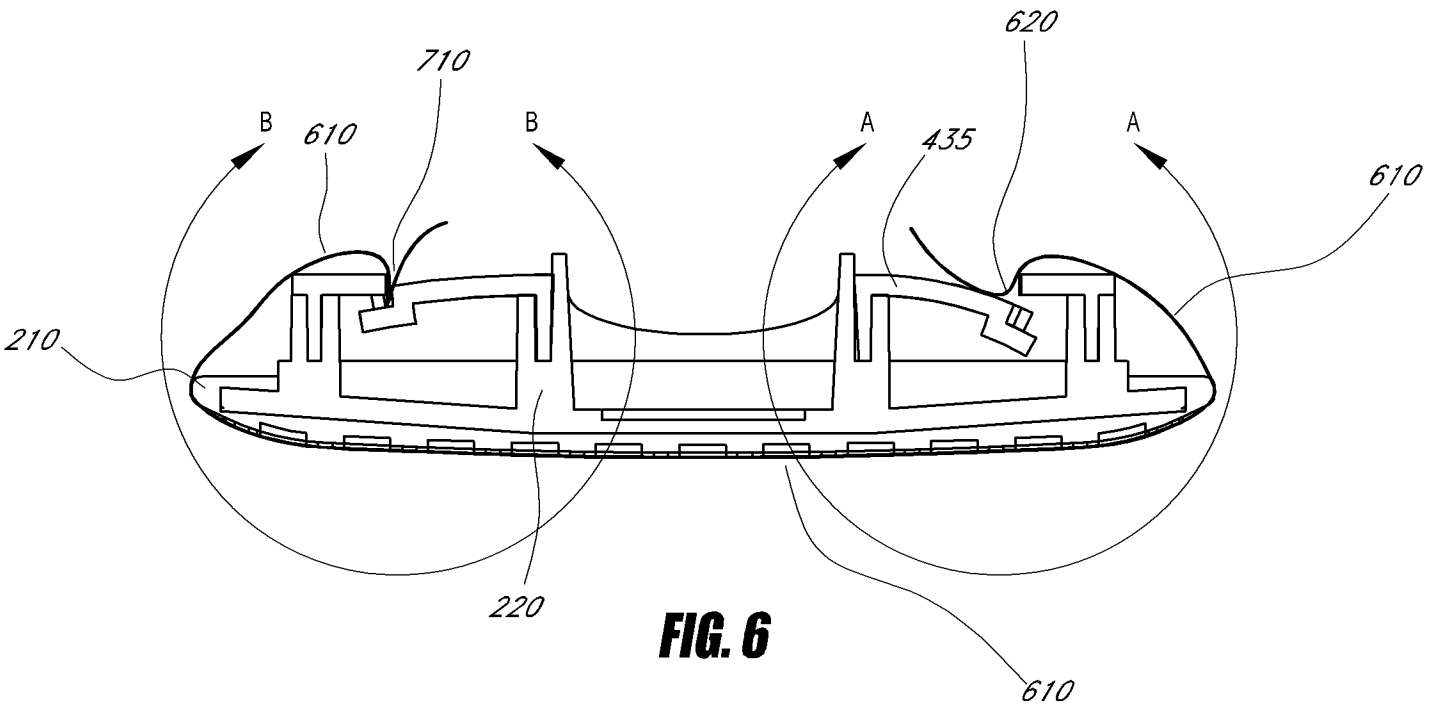
FIG. 6 illustrates an orthographic view of flexed portions (as for sheet insertion or removal) of an embodiment such as that of FIG. 1.

FIG. 5 and FIG. 6 are two sectional views of an embodiment of a support structure with traps 260 in a flexed or open position. These figures illustrate an example of how the jaws 230, 240 may flex, such as during insertion of an object such as a sheet 610 or after insertion and before removal of such an object.

A sheet 610 is being inserted into a trap 260 on the right hand side of FIG. 5 (and FIG. 6). Pressure is applied to the upper portion 435 of inner jaw 230, causing it to flex downward. This moves the forward edge (a component of slit 270) below the forward edge of the upper portion 445 of the outer jaw 240, creating or increasing the gap between the two upper portions 435, 445.

In some embodiments, a user may flex the upper portion 435 by applying pressure with one or more fingers, for example. In other embodiments, a tool such as a pointer or stylus might be used.

In operation, a user might place a sheet 610 so that a first end portion of the sheet 610 is aligned with the slit 270 and overlapping at least some of the upper portion 435. Pressing down on that end portion of sheet 610 overlapping the upper portion 435 (e.g., with a finger or tool) flexes the upper portion 435 down, and allows the user to push a portion of the sheet 610 into the trap 260. A portion of the sheet 610 may be considered "in" the trap 260 if it extends below or past the upper portion 435, or at least past a bottom surface of the upper portion 445 such that it relatively fixed in slit 270 when downward pressure is removed from upper portion 435. A portion of the sheet 610 may be deeper in the trap 260 as well, such that portions extend below any seal portion 437 or into cavity 410.

The left side of FIG. 5 (and FIG. 6) illustrates a trap 260 in which a second portion of the sheet 610 has already been inserted into a trap 260. Typically this second portion of the sheet 610 is proximate to or includes a second end portion of the sheet 610 which is opposite to the first end portion. However, so long as there is enough of the sheet 610 between the two portions to allow the sheet to span pad 200 (or, for example, the sheet 610 is configured to stretch appropriately), any portions of the sheet 610 can be inserted in the two traps 260.

Note that on the left hand side of FIG. 5 (and FIG. 6), upper portion 435 of inner jaw 230 has relaxed so that its forward edge is proximate to and substantially parallel to the forward edge of the upper portion 445 of outer jaw 240, allowing for any displacement caused by material (e.g. the second portion of sheet 610) between the two forward edges, beneath a lower surface of the upper portion 445 and an upper surface of the seal portion 437, or otherwise impeding the upper portion 435 from returning to the relaxed position.

Although traps 260 such as those illustrated can be used to hold sheets 610 in a variety of manners and for a variety of purposes, when used with a support structure such as that illustrated, they may be used to hold a sheet 610 relatively taut around the bottom surface 310 of a pad 200, such as when holding a dusting, mopping, or cleaning sheet around a head or pad 200. This is illustrated in FIG. 6, as well as in FIG. 5.

Closer View of Traps in a Flexed (Open) Position

Figure 7:
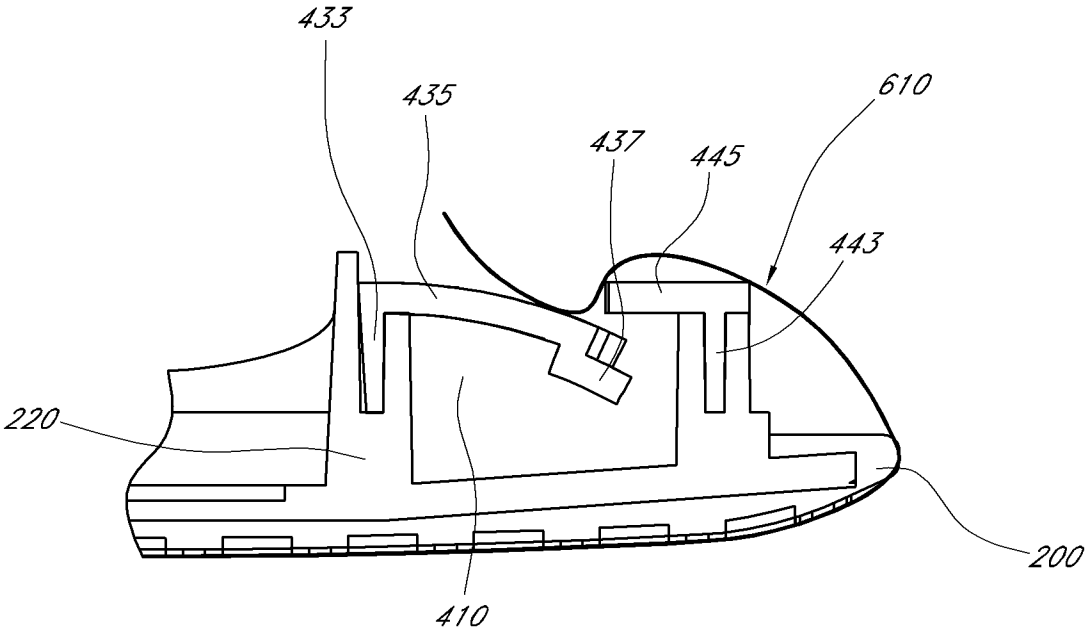
FIG. 7 illustrates a detailed orthographic view of region A of the embodiment illustrated in FIG. 6.
Figure 8:
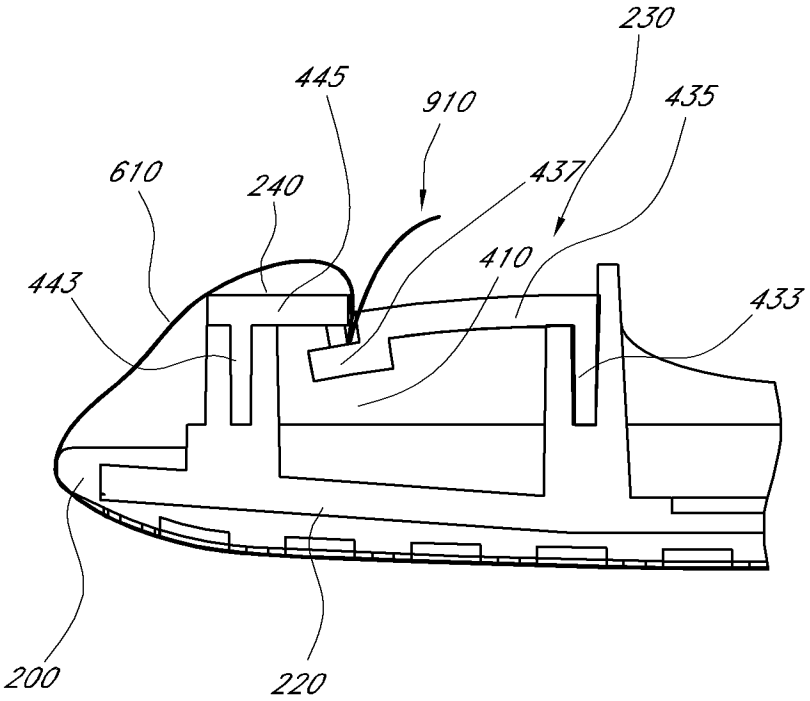
FIG. 8 illustrates a detailed orthographic view of region B of the embodiment illustrated in FIG. 6.

FIG. 6 contains areas marked A and B. FIG. 7 illustrates a closer view of area A and FIG. 8 illustrates a closer view of area B. Like the left hand side of FIG. 5 and area A of FIG. 6, FIG. 7 shows the cleaning sheet 610 before insertion into the trap 260 between inner jaw 230 and outer jaw 240. The fingers of an operator or user are not shown in FIG. 7, but another means (in addition to that disclosed above) by which the sheet 610 may be inserted is by pushing down the inner jaw 230 with all four fingers of one hand (thumb excluded; fewer fingers may be used) while at the same time tucking the sheet 610 into the trap 260 (e.g., under upper portion 445 and beyond the forward edge of upper portion 435).

FIG. 8 shows sheet 610 after insertion into a trap 260. The sheet 610 is securely gripped by the jaws 230, 240 and in some embodiments cannot come out without exerting substantially the same downward pressure on inner jaw 230 as was used when sheet 610 was inserted. If insertion is accomplished in such a way that a fold of sheet 610 is inserted into a trap 260 as is illustrated in the figures (an alternative is to insert a portion of sheet 610 including an edge into a trap 260) then removal may be accomplished by the operator or user by pulling on a protruding loose end 910 of the fold of sheet 610. If the inner jaws 230 are configured so that the forward surface of the upper portion 435 has rounded teeth, e.g., then it will likely not bind to the sheet 610, allowing the sheet 610 to smoothly slide out of the trap 260.

Not shown in FIG. 7 and FIG. 8 are the above-mentioned teeth. Embodiments may have teeth extending from the forward surface of forward portion 445, the forward surface of forward portion 435, neither, or both. Teeth may be integral with the upper (forward) portions 435, 445, or they may be attached, optionally removably, to those upper portions. The teeth may be formed of the same materials as the upper (forward) portions from which they extend, or they may be formed of more or less flexible rigid material.

Using Gaps to Allow Some Slack

As can be seen in FIG. 1 and FIG. 3, gaps 250 may be present in traps 260. That is, slit 270 may not extend the full length of trap 260. Alternatively, sheet 610 may be inserted into trap 260 such that the portion of the sheet 610 inserted into the trap 260 does not extend for the full length of the edge of the sheet 610. Another alternative is that trap 260 is shorter than edge of the sheet 610 corresponding to the portion of the sheet 610 inserted into the trap 260. Embodiments may use some or all of these approaches or functional equivalents. The result is that some, but not all, of a portion of sheet 610 (such as a portion proximate to an edge of sheet 610, as illustrated in the figures) is inserted in trap 260. If a corresponding but opposite portion of sheet 610 is also not fixed in the second trap 260 when the sheet 610 is wrapped around the bottom 310 of the pad 200 and otherwise secured in the traps 260 as described herein (for example), then there will be more give or slack (or less tautness) in that portion of the sheet 610 between the two unsecured portions than between two secured portions.

A gap 250 may be approximately 40 mm long. In other embodiments it may range from approximately 20 mm to approximately 60 mm, and may be longer or shorter. A gap 250 may be approximately 7 mm wide, and some embodiments may include a gap 250 with a width of approximately 3 mm (or less) to approximately 25 mm (or more).

This may be used to allow for sensors, such as those described above, which press down on the sheet 610. As can be seen in FIG. 1, there are two pairs of gaps 250 generally correlated to the locations of the two holes 280. The slack allowed for by the pairs of gaps 250 may reduce the risk of a sheet 610 tearing if a sensor exerts pressure on it. The slack may also allow for a vertical probe to drop by a larger amount when the area of the pad 200 located in proximity of the hole 280 looses contact with the floor or other surface.

Other Alternative Embodiments

The above disclosure has largely been presented in terms of inner jaw 230 having a flexible upper portion 435 while outer jaw 240 has a relatively rigid upper portion 445. In some embodiments, the opposite may be true, or both may have flexible upper portions.

Some embodiments of a trap 260 may have an inner jaw 230 with a relatively rigid upper portion 445 but which is flexibly attached to a base portion 433. Some embodiments may have relatively rigid upper portions 445 which are relatively rigidly attached to a base portion 433, but the base portion 433, although relatively fixed to a substrate such as pad 200 or support chassis 220, is relatively flexible. Embodiments such as these may function according to the principles discussed above. The same alternatives may also apply to outer jaw 240.

A support structure may have traps 260 that differ in configuration from one another or that are substantially similar or identical.

The systems described herein can advantageously be implemented using a variety of materials, and this disclosure is not meant to limit the suitability of any material known now or discovered or created in the future. In an example embodiment, a portion of the embodiment is flexed by the application of force and then substantially resumes the position it had prior to the application of force. In addition to any materials specifically disclosed herein, any material that responds as described may be used for the corresponding portion of an embodiment. Some embodiments may be composed of multiple materials, or be constructed so that the method of construction gives the assembled entity the necessary properties even though the materials from which the embodiment is composed do not (e.g., in much the same way a trussed wooden bridge can support more weight than an untrussed bridge, or that a piece of paper can support more weight when spanning a gap if rolled into a tube than if unrolled and flat. It is further contemplated that different means of construction and assembly (e.g., gluing versus screwing versus welding versus carving out from a source substrate) may be used to create embodiments.

Various aspects and advantages of the embodiments have been described where appropriate. It is to be understood that not necessarily all such aspects or advantages may be achieved in accordance with any particular embodiment. Thus, for example, it should be recognized that the various embodiments may be carried out in a manner that achieves or optimizes one advantage or group of advantages as taught herein without necessarily achieving other aspects or advantages as may be taught or suggested herein. Further, embodiments may include several novel features, no single one of which is solely responsible for the embodiment's desirable attributes or which is essential to practicing the systems, devices, methods, and techniques described herein.

What is claimed is:

1. A sheet affixing method comprising:

placing a sheet against a first surface of a platform of a robot, the robot configured to move in an environment in accordance with logic contained in an on-board processor;

applying a force in a first direction to a second forward portion of a second jaw of a first trap, wherein the first trap comprises:

a first jaw, comprising a first base portion and a first forward portion, the first forward portion having a first forward surface; and the second jaw, comprising a second base portion and the second forward portion, the second base portion of the second jaw spaced from the first base portion of the first jaw, and the second forward portion having a second forward surface and flexible in at least a first direction substantially orthogonal to the second forward portion, and wherein the applied force causes the second jaw to flex in the first direction so as to space the second forward surface, of the second forward portion of the second jaw, further from the first forward surface of the first forward portion of the first jaw than prior to the application of the force;

inserting, while applying the force to the second forward portion, a portion of the second portion of the sheet at least into the space between the first forward surface of the first forward portion of the first jaw of the first trap and the second forward surface of the second forward portion of the second jaw of the first trap;

removing the applied force from the second forward portion of the second jaw of the first trap, wherein when the second jaw is relaxed, the second forward portion of the second jaw is substantially coplanar with the first forward portion of the first jaw and the second forward surface of the second forward portion of the second jaw faces the first forward surface of the first forward portion of the first jaw; and affixing the third portion of the sheet in a second trap.

2. The method of claim 1, wherein affixing the third portion of the sheet in the second trap comprises:

applying a force in the first direction to a fourth forward portion of a fourth jaw of the second trap, wherein the second trap comprises:

a third jaw, comprising a third forward portion, the third forward portion having a third forward surface; and the fourth jaw comprising the fourth forward portion, the fourth forward portion having a fourth forward surface, wherein the applied force to the fourth forward portion causes the fourth jaw to flex in the first direction so as to space the fourth forward surface of the fourth forward portion of the fourth jaw further from the third forward surface of the third forward portion, of the third jaw, than prior to the application of the force to the fourth forward portion;

inserting, while applying the force to the fourth portion, a portion of the third portion of the sheet at least into the space between the third forward surface of the third forward portion of the third jaw of the second trap and the fourth forward surface of the fourth forward portion of the fourth jaw of the second trap; and removing the applied force from the fourth forward portion of the fourth jaw.

3. The method of claim 1, wherein the force is applied using a finger.

4. The method of claim 1, wherein the portion of the second portion of the sheet inserted into the space between the first forward surface of the first forward portion of the first jaw of the first trap and the second forward surface of the second forward portion of the second jaw comprises a portion of the sheet proximate to a first edge not including any part of the first edge.

5. The method of claim 4, the method further comprising removing the sheet from the first trap, removing comprising pulling on a portion of the first edge.

6. The method of claim 1, the method further comprising magnetically mounting the platform to a housing.

7. The method of claim 1, the method further comprising mounting the platform to a housing, wherein the platform has at least a first sensor opening, so that a sensor mounted in the housing is in contact with at least one portion of the sheet.

8. The method of claim 1, the method further comprising mounting the platform on a housing, wherein the platform has at least a first sensor opening, so that a drop off sensor mounted in the housing can sense a drop off condition.

9. The method of claim 1, wherein the first forward surface comprises a scalloped surface opposed to the second forward surface.

10. The method of claim 1, wherein the first forward surface comprises an edge.

11. A method comprising:

placing a sheet against a first surface of a platform of a robot, the robot configured to move in an environment in accordance with logic contained in an on-board processor;

applying a force in a first direction to a second forward portion of a second jaw of a first trap, wherein the first trap comprises:

a first jaw, comprising a first base portion and a first forward portion, the first forward portion having a first forward surface; and the second jaw, comprising a second base portion and the second forward portion, the second base portion of the second jaw spaced from the first base portion of the first jaw, and the second forward portion having a second forward surface and flexible in at least a first direction, wherein the applied force causes the second jaw to flex so as to space the second forward surface, of the second forward portion of the second jaw, further from the first forward surface of the first forward portion of the first jaw than prior to the application of the force;

inserting, while applying the force to the second forward portion, a first portion of the sheet at least into the space between the first forward surface of the first forward portion of the first jaw of the first trap and the second forward surface of the second forward portion of the second jaw of the first trap; and removing the applied force from the second forward portion of the second jaw of the first trap, wherein when the second jaw is relaxed, the second forward portion of the second jaw is substantially coplanar with the first forward portion of the first jaw and the second forward surface of the second forward portion of the second jaw faces the first forward surface of the first forward portion of the first jaw.

12. The method of claim 11, the method further comprising affixing the second portion of the sheet in a second trap.

13. The method of claim 11, the method further comprising affixing the second portion of the sheet in a second trap, wherein affixing the second portion of the sheet in the second trap comprises applying a force to a fourth forward portion of a fourth jaw of the second trap, wherein the second trap comprises:

a third jaw, comprising a third forward portion, the third forward portion having a third forward surface; and the fourth jaw comprising the fourth forward portion, the fourth forward portion having a fourth forward surface, wherein the applied force to the fourth forward portion causes the fourth jaw to flex so as to space the fourth forward surface of the fourth forward portion of the fourth jaw further from the third forward surface of the third forward portion, of the third jaw, than prior to the application of the force to the fourth forward portion;

inserting, while applying the force to the fourth portion, the second portion of the sheet at least into the space between the third forward surface of the third forward portion of the third jaw of the second trap and the fourth forward surface of the fourth forward portion of the fourth jaw of the second trap; and removing the applied force from the fourth forward portion of the fourth jaw.

14. The method of claim 11, wherein the force is applied using a finger.

15. The method of claim 11, wherein the first portion of the sheet inserted into the space between the first forward surface of the first forward portion of the first jaw of the first trap and the second forward surface of the second forward portion of the second jaw comprises a portion of the sheet proximate to a first edge not including any part of the first edge.

16. The method of claim 11, the method further comprising removing the sheet from the first trap, removing comprising pulling on a portion of the first edge.

17. The method of claim 11, the method further comprising magnetically mounting the platform to a housing.

18. The method of claim 11, the method further comprising mounting the platform to a housing, wherein the platform has at least a first sensor opening, so that a sensor mounted in the housing is in contact with at least one portion of the sheet.

19. The method of claim 11, wherein the first forward surface comprises a scalloped surface opposed to the second forward surface.

20. The method of claim 11, wherein the first forward surface comprises an edge.

* * * * *

UNITED STATES PATENT AND TRADEMARK OFFICE

CERTIFICATE OF CORRECTION

PATENT NO. : 8,869,338 B1
APPLICATION NO. : 13/685476
DATED : October 28, 2014
INVENTOR(S) : Michael Dooley et al.

It is certified that error appears in the above-identified patent and that said Letters Patent is hereby corrected as shown below:

On the Title Page

Page 1 (item 73, Assignee) at line 1, Change "Beford," to --Bedford,--.

In the Specification

In column 5 at line 30, Change "that that" to --that--.

Signed and Sealed this
Nineteenth Day of May, 2015

Michelle K. Lee

Michelle K. Lee
*Director of the United States Patent and Trademark Office*